United States Patent [19]

Neiser

[11] Patent Number: 4,819,803

[45] Date of Patent: Apr. 11, 1989

[54] STABILIZING CARRIER FOR A FLORAL CONTAINER

[76] Inventor: J. Ray Neiser, 7503 S. M St., Tacoma, Wash. 98408

[21] Appl. No.: 833,326

[22] Filed: Feb. 25, 1986

[51] Int. Cl.[4] ..... B65D 85/52

[52] U.S. Cl. ..... 206/423; 206/485; 206/45.14; 248/152; 248/346; 215/100.5

[58] Field of Search ..... 206/45.14, 423, 476, 206/485; 229/40, 87 P, 87 F; 248/152, 346, 346.1; 47/41 R, 41.1, 41.11, 41.13; D11/143, 144, 146, 152, 153, 154; 215/100.5

[56] References Cited

U.S. PATENT DOCUMENTS

| | | | |
|---|---|---|---|
| D. 271,833 | 12/1983 | Okada | D11/143 |
| 603,649 | 5/1898 | Leedy . | |
| 1,469,536 | 10/1923 | Risley | 206/423 |
| 1,638,480 | 8/1927 | Feybusch | 206/485 |
| 1,954,006 | 4/1934 | Wolf | 206/423 |
| 1,990,372 | 12/1933 | Cole | 65/53 |
| 2,143,045 | 1/1939 | Wicks | 65/53 |
| 2,588,791 | 3/1952 | Andrew, Jr. | 229/40 |
| 2,664,670 | 1/1954 | Mulford | 206/423 |
| 2,774,475 | 12/1956 | Morken | 229/40 |
| 2,821,297 | 1/1958 | Callinicos | 206/46 |
| 2,959,339 | 11/1960 | Sierk et al. | 206/485 |
| 3,297,289 | 1/1967 | Raus | 47/41 |
| 3,666,089 | 5/1972 | Souza | 229/40 |
| 3,881,674 | 5/1975 | Greene, III | 47/41 R |
| 4,078,658 | 3/1978 | Neiser | 206/423 |
| 4,204,598 | 5/1980 | Adams | 248/346 |
| 4,248,347 | 2/1981 | Trimbee | 206/423 |

*Primary Examiner*—David T. Fidei

*Attorney, Agent, or Firm*—Delbert J. Barnard

[57] ABSTRACT

The lower end of a bud vase (V, V') or some other floral container (V'') sets onto a center portion of a base panel (26, 26') of a carrier (10, 10'). End walls (28, 30 or 28', 30') extend upwardly from the base panel (26, 26'). Top panels (32, 32', 34, 34') extend inwardly from the upper ends of the endwalls (28, 28', 30, 30'), with one (34, 34') overlapping the other (32, 32'). Each top panel (32, 32', 34, 34') includes a recess (40, 40', 42, 42'). The recesses (40, 40', 42, 42') together define a variable size opening for receiving a portion of the floral container (V, V', V''). The top walls (32, 32', 34, 34') are slid relatively together, or apart, while overlapped, to adjust the size of the opening. Each recess (40, 40', 42, 42')has a semi-oval shape and is deeper than it is wide at its widest location.

12 Claims, 3 Drawing Sheets

STABILIZING CARRIER FOR A FLORAL CONTAINER

TECHNICAL FIELD

This invention relates to an adjustable carrier for floral containers, adapted to hold the floral container and its contents in an upright position, particularly during transportation in a motor vehicle.

BACKGROUND ART

In my U.S. Pat. No. 4,078,658, entitled Carrier for Handling and Transporting Potted Plants, granted Mar. 14, 1978, I have described in detail the problems involved in transporting a potted plant in a vehicle.

U.S. Pat. No. 4,078,658 relates to a stabilizing carrier for a potted plant. Generally speaking, such carrier comprises a bottom panel, a pair of ends which are hinge connected to the bottom, and a pair of top panels which are hinge connected to the tops of the end panels. One top panel overlaps the other. An opening is provided in each top panel. When the carrier is assembled, the openings are in alignment. In use, a potted plant is set down into the aligned openings onto the bottom of the carrier. The inner-fit of the pot in the two openings holds the carrier in an assembled position. The carrier provides the pot with a wide stable base and this base prevents the pot from tipping over during transportation.

A principal object of the present invention is to provide a stabilizing carrier for a floral container which is easily adjustable for use with a range of sizes of floral containers.

I am aware of U.S. Pat. No. 4,248,347, entitled Packaging for Florist Arrangements, granted Feb. 3, 1981, to Robert J. Trimvee. This patent discloses a base attachment for a flower container which can be adapted for use with several sizes of flower containers. The base attachment for the flower container comprises a base panel and two flaps connected to the base panel. Each flap is formed to include a plurality of spaced-apart rolls of perforations, each designed to provide a different size of recess in the flap. The closed ends of the recesses are circular. The material is separated along a line of perforations for a recess conforming to the size of the floral container with which the carrier is to be associated. The base of the floral container is set down on the base of the carrier. Then, one flap is folded over the top of the base panel and the recess in such flap is positioned about a stem portion of the floral container. Then, the second flap is folded down over the first flap, with the stem of the container fitting within its recess. The two recesses together form a circular opening in which the stem portion of the container is received. The two flaps are stapled together to secure the carrier in position. A problem with this type of carrier is that the perforations must be parted to form the recesses in the flaps and care must be taken to see that the right roll of perforations are severed, without inadvertent severing of any other roll of perforations. Also, it takes time to sever the perforations to make the recesses. Also, the carrier is usable only with a container having a flat base and a narrow stem portion positioned closely adjacent the bottom of the base. This type of carrier is not suitable for use with a vase that is both tall and narrow, such as a bud vase. If an attempt were to be made to use the carrier disclosed by this patent with a vase which did not include a relatively flat base and a narrow neck portion immediately above the base, the stapling action would cause the bottom panel of the carrier to bend, rather than the panels 28, 30.

U.S. Pat. No. 2,821,297, granted Jan. 28, 1958, to James N. Callinicos relates to an adjustable carton for use in protecting potted plants and other sorts of floral displays, to keep them from tipping over, during transportation. The carton disclosed by this patent requires much more material to manufacture than does my carrier, and it requires a considerable amount of manipulaton of parts, in order to assemble it and adjust it for use with a particular size floral container.

U.S. Pat. No. 603,649, granted May 10, 1898, to Carrie H. Leedy discloses moving a pair of members together, from opposite sides of a floral container, so that recesses in such members can come together about a neck portion of the floral container, and then sliding the floral container and such members into a box, and outer edge portions of the members into slots formed in side portions of the box. This manner of protecting a floral arrangement during transportation requires a box that is expensive to construct.

I am also aware of U.S. Pat. No. 1,990,372, granted Feb. 5, 1935, to Hobart F. Cole, and U.S. Pat. No. 2,143,045, granted Jan. 10, 1939, to Mildred I. Wicks. Both of these patents relate to an add-on stabilizing base for a goblet which is characterized by a base panel on which the base of the goblet sets, and a pair of recess carrying flaps connected to opposite edges of the base panel, and movable together around the stem of the goblet, so that the stem of the goblet is received within an opening formed by the two recesses. The devices disclosed by these patents are not adjustable and they are not suitable for use with a floral container which is relatively tall and narrow, such as a bud vase.

It is an object of the present invention to provide for a floral container of a stabilizing carrier which is simple in construction and utilizes a minimum of material, and hence is inexpensive to manufacture, and which is easily adjustable to fit a plurality of sizes of floral containers, and is usable to hold and stabilize a floral container which is both tall and narrow, such as a bud vase.

Disclosure of the Invention

The stabilizing carrier for a floral container, of the present invention, is basically characterized by a bottom, two end walls and a top. The top is formed by two overlapping top panels. The top panels are hinge connected at their outer ends to the upper ends of the end walls. The lower ends of the end walls are pivotally connected to the bottom. Each top panel includes a semi-oval recess extending inwardly from its free edge. A bud vase or other floral container is set down on the bottom of the carrier and then the end walls and top panels are swung together, to move the two recesses together and towards the container, from opposite sides of the container. The top panels are overlapped and slid together until portions of the closed inner ends of the recesses contact the opposite sides of the container. Then, the top panels are stapled or otherwise secured together. The carrier provides a large stabilizing base structure for the floral container, so that it can be set down on its support surface in a vehicle, or carried, and delivered to a customer, or taken home, without danger of the container and its contents tipping over.

In accordance with the present invention, the recesses in the top panel are shaped to make engaging contact with opposing side regions of a plurality of different sized floral containers, by a mere adjustment of the amount of top panel overlap. A change in the amount of top panel overlap will always change the length dimension of the opening formed by the two recesses. If a recess were to be used of a type formed by a semi-circular cut-out in combination with straight portions at the side, such as disclosed by the aforementioned U.S. Pat. No. 4,248,347, a change in the amount of top panel overlap would make no change in the width dimension of the opening formed by the two recesses. In accordance with the present invention, the recesses are shaped such that a mere adjustment in the amount of top panel overlap changes both the length and the width dimensions of the opening defined by the two recesses.

In accordance with another aspect of the invention, each end panel is formed to include a brace flap. Each brace flap includes a generally vertical hinge connection to its end panel. Each brace flap also includes a lower end positioned to make bracing contact between the end wall and the bottom of the carrier when the flap is bent about its hinge connection, to project inwardly of the carrier from its end wall, and the top panels are together to form the carrier top.

In accordance with another feature of the invention, the lower end portion of each flap may be positioned to make a frictional contact with the bottom of the carrier when the flap is turned to extend inwardly of the carrier from its end wall. In preferred form, each flap includes a recess in its lower edge, positioned to provide a finger laterally outwardly from said recess. The finger is positioned to contact the bottom of the carrier when the flap is turned to extend inwardly from its end wall. The finger makes a frictional contact with the bottom of the carrier, and is able to bend somewhat, if necessary.

These and other features, objects, and advantages of the invention are hereinafter described, as part of a description of the best mode.

BRIEF DESCRIPTION OF THE DRAWING

In the drawings, like reference numerals are used throughout the several figures of the drawings, to identify like parts, and.

Best Mode for Carrying Out the Invention

Figure 1:
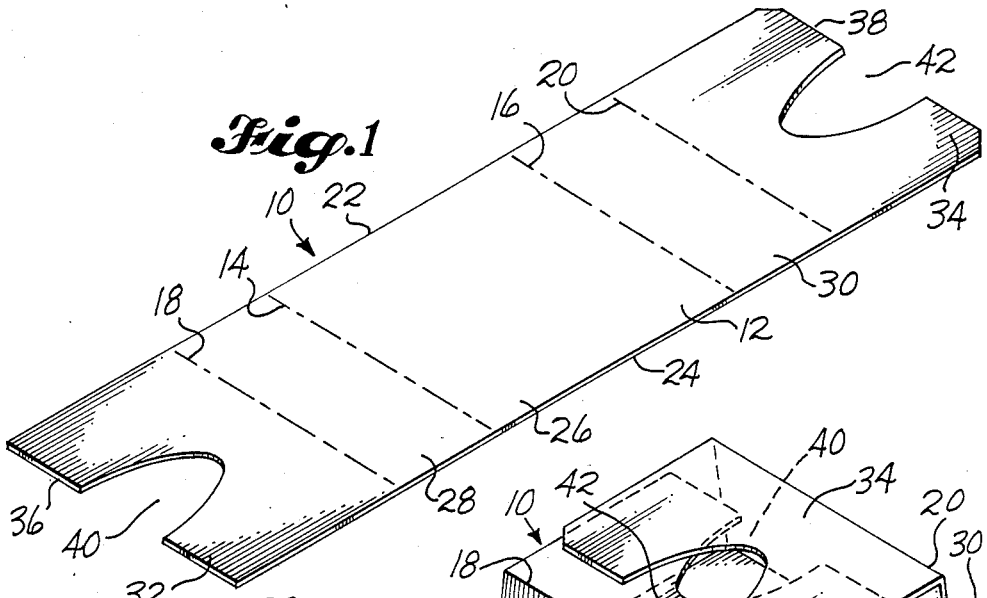
FIG. 1 is an isometric view of a blank for forming a first embodiment of a stabilizing carrier for a floral container, embodying the present invention.

In preferred form, the carrier 10 is formed from a unitary blank 12 (FIG. 1). The blank 12 is substantially rectangular in shape and includes four spaced apart fold lines 14, 16, 18, 20. Preferably, the blank 12 is formed from conventional corrugated cardboard with the corrugations thereof extending substantially parallel to the longitudinal edges 22, 24 of the blank 12. Other suitable materials can be employed and include plastic sheet material and paperboard material other than corrugated cardboard. It is only necessary that the material be a relatively stiff, lightweight material.

The fold lines 14, 16, 18, 20 are substantially parallel to each other and substantially perpendicular to the longitudinal edges 22, 24 of the blank 12. Each fold line 14, 16, 18, 20 structurally weakens a zone of the blank 12 such that the blank can easily be folded or pivoted upwardly about a fold line 14, 16, 18, 20. The fold lines 14, 16, 18, 20 thus provide hinge connections between the panels on the opposite sides of the fold lines 14, 16, 18, 20.

Techniques for forming such fold lines 14, 16, 18, 20 are well-known in the art. For example, corrugated cardboard blanks are generally creased along such fold lines by a creasing machine to collapse the corrugations and render the blank easily foldable about a shallow identation formed by the creasing operation. In a similar fashion, blanks made of plastic sheet material are often scored along such a fold line by cutting a narrow, shallow groove in the surface of the blank or, in the case of thermoplastic materials, forming such a groove by heating the narrow strip of the blank.

Regardless of the type of material employed in the construction of the blank 12, or the manner in which the fold lines 14, 16, 18, 20 are formed, the fold lines 14, 16, 18, 20 partition the blank 12 into five substantially rectangular regions for forming a bottom panel 26, two oppositely disposed end panels 28, 30 and two top panels 32, 34. The top panels 32, 34 together form a top for the carrier 10 when the blank 12 is folded to form the carrier 10.

More explicitly, a rectangular bottom panel 26 is defined between the longitudinal edges 22, 24 and the fold lines 14, 16; a first end panel 28 is defined between the longitudinal edges 22, 24 and the fold lines 14, 18; a second end panel 30 is formed between the side edges 22, 24 and the fold lines 16, 20; a first top panel 32 is defined between the side edges 22, 24, thefold line 18, and a first end 36 of the blank 12; and, a second top panel 34 is defined between the side edges 22, 24, the fold line 20, and a second end 38 of the blank 12.

Figure 2:
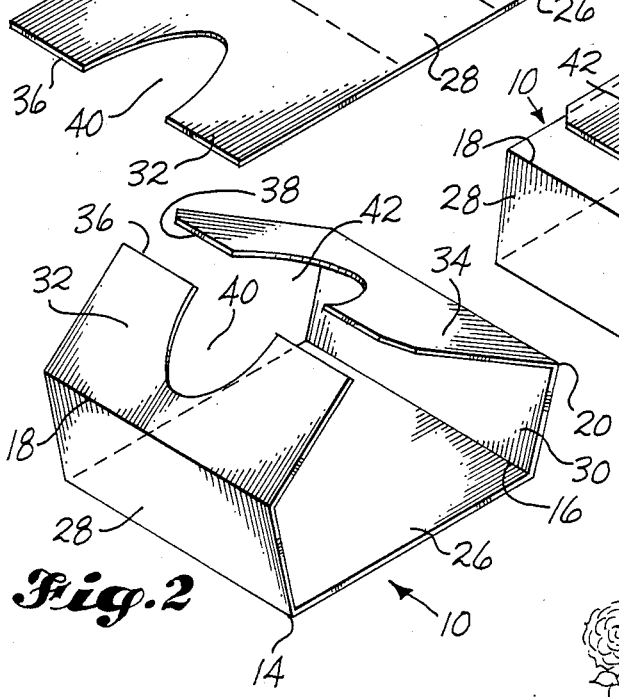
FIG. 2 is an isometric view illustrating the folding operation utilized in forming a floral container carrier from the blank depicted in FIG. 1.
Figure 3:
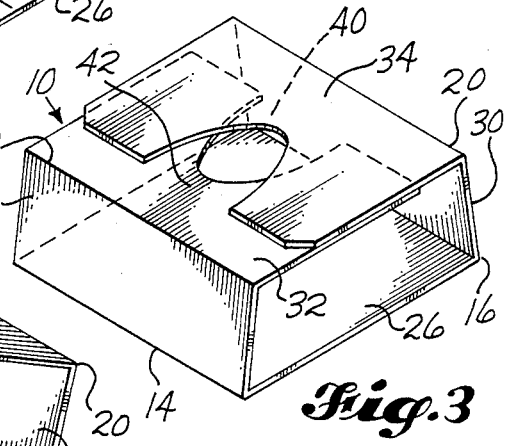
FIG. 3 is an isometric view depicting the embodiment of FIG. 1 in a completely folded position.

Generally, the fold lines 14, 16, 18, 20 are arranged such that the two top panels 32,34 are of approximately equal longitudinal dimension, such longitudinal dimension normally being somewhat less than the longitudinal direction of the bottom panel 26. Additionally, the fold lines 14, 16, 18, 20 are positioned such that the end panels 28, 30 are of equal longitudinal dimesnion. With this arrangement, when the blank 12 is folded to form the carrier 10 (FIGS. 2 and 3), the end panels 28, 30 are oppositely disposed relative to one another and extend upwardly from the bottom panel 26 at an angle that is under ninety degrees relative to the upper surface of the bottom panel 26. Further, the top panel 332 is folded about the fold line 18 and the top panel 34 is folded about the fold line 20, such that the top panel 34 assumes a superposed contacting relationship with the top panel 32.

Semi-oval cutouts or recesses 40, 42 are formed in the top panels 32, 34. Recess 40 extends inwardly from the end 36 of the blank 12. In similar fashion, recess 42 extends inwardly from the end 38 of the blank 12.

In accordance with this invention, the recesses are of a shape to make engaging contact with opposing side regions of a plurality of different size floral containers, by a mere adjustment of the amount of overlap of the top panels 32, 34. Owing to the shape of the recesses, an adjustment in the amount of overlap of the top panels 32, 34 results in a change in both the length and width dimensions of the opening formed by the recesses 40, 42.

When the blank 12 is assembled to form the carrier 10, the blank 12 is folded upwardly about the fold lines 14, 16. A floral container V is set down onto the central region of the bottom panel 26. The top panel 32 is folded downwardly about the fold line 18, to move the recess 40 into engagement with a side region of the floral container V. Then, the top panel 34 is folded in a similar fashion about fold line 20, to place recess 42 into a position of engagement with an opposite side region of the floral container V. The two top panels 32, 34 are slid together, while in their overlapping relationship, until border regions of the recesses 40, 42 make contact with the opposite side regions of the floral container V. Then, the top panels 32, 34 are connected together, such as by stapling.

Figure 4:
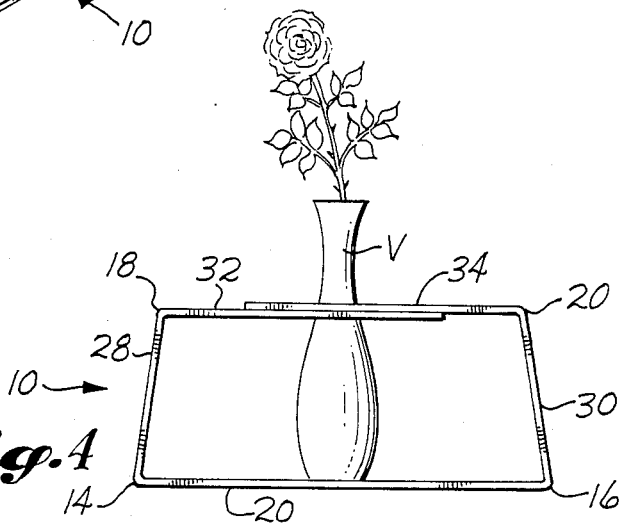
FIG. 4 is a side elevational view of the carrier, showing a bud vase secured in place within the carrier.

By way of typical and therefore nonlimitative example, a carrier 10 adapted for a bud vase V may measure seven inches in width, between the edges 22, 24. The bottom panel 26 may measure seven and one half inches in length. End wall 28 may measure three inches in length. End wall 30 may measure three and one eighth inches in length. Top panels 32, 34 may each measure five inches in length. The length differential between end wall 30 and end wall 28 is essentially equal to the thickness of the material used for forming the blank 12. As shown by FIG. 4, this length differential enables top panel 34 to be placed in an overlapping position over top panel 32, with the top and bottom surfaces of the top panels 32, 34 being parallel with the bottom panel 26. It also enables the vase engaging opening formed by the recesses 40, 42 to be adjustable in size by a mere sliding movement of top panel 34 relative to top panel 32.

If the example carrier 10 that has just been described is assembled, and the top panels 32, 34 are slid together until the end surface 36 of end panel 34 makes contact with the upper portion of end wall 30, the carrier would measure five inches in length at its top and seven and one half inches in length at its bottom. The opening formed by the closed ends of the recesses 40, 42 would be at its smallest possible dimension. It would be elongated laterally of the carrier 10.

The end boundary at the closed end of each recess 40, 42 is located a distance from the fold lines 18, 20 which results in the opening that is defined when the end members 32, 34 are overlapped the full extent being undersized relative to any bud vase V that would be placed in the carrier 10.

Figure 5:
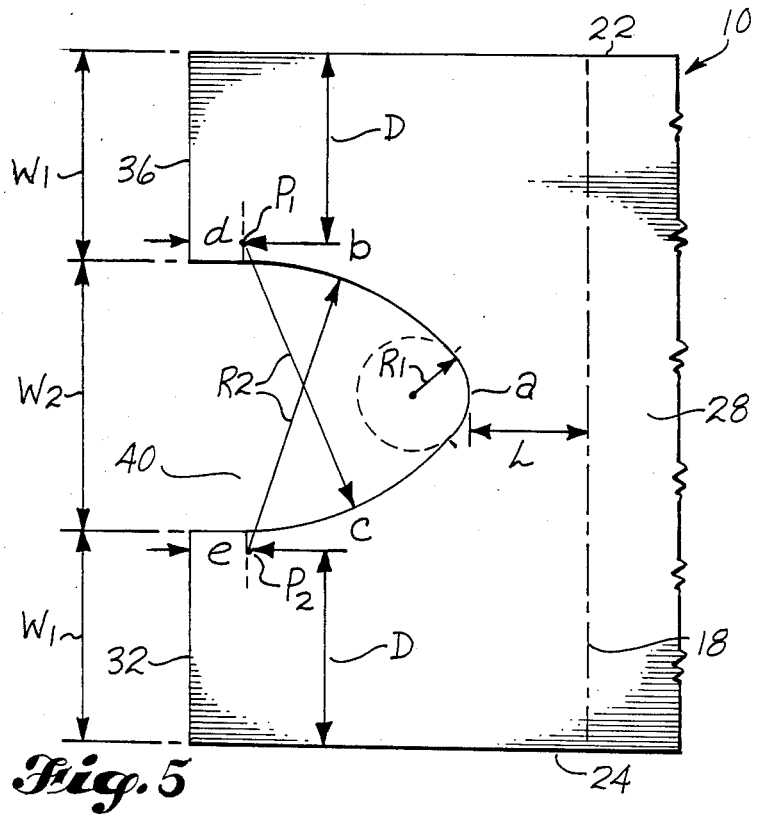
FIG. 5 is a top plan view of a portion of a top panel, showing a preferred construction of the top panel recess.
Figure 6:
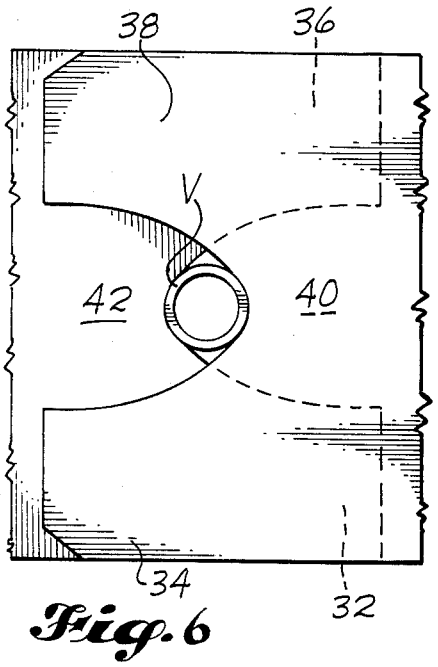
FIG. 6 is a fragmentary top plan view of a carrier in its folded condition, with the two recesses in the top panels cooperating to form an opening in which an intermediate portion of a bud vase is received.

Referring to FIG. 5, in preferred form, the recesses 40, 42 are divided into five regions. Region a is at the closed end of the recess 40, 42. Preferably, it is an arc of circular curvature. Regions b, c may also be regions of circular curvature, having centers at points P1, P2. Regions d, e may be straight regions, each being parallel to the other.

In the bud vase example that has been described above, as a typical example, the dimension L may measure about two and one eighth inches. The radius of curvature R1 may measure about one half inch. The radius of curvature R2 may measure about two and seven eights inches. The straight regions d, e may measure about five eighths inches in length. W1 may measure about two and one eighth inches. W2 may measure two and three quarters inches. D may be about two inches.

The arc length of region a may be about ninety degrees (90°). The arc length of regions b, c may be about forty-five degrees (45°).

The carrier 10 is designed for use with a minimum size container V which measures about one inch in diameter where it extends through the opening formed by the recesses 40, 42. Such a bud vase V would be contacted at opposite diameter regions by the curved regions a of the recesses 40, 42. Of course, the carrier 10 could still be used with a container V that is smaller in diameter than one inch, by a sliding of the two end panels 32, 34 together until contact is made between the regions a of the recesses 40, 42 and the opposite side of the container V.

In the example described above, when the overlap of the top panels 32, 34 is such that the dimension of the opening between the regions a measures one inch, there is a space between edge 38 and fold line 18 measuring about one quarter inch.

Figure 7:
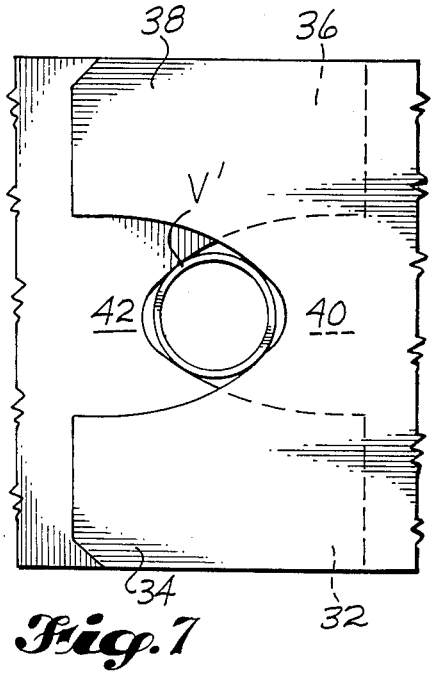
FIG. 7 is a view like FIG. 6, showing a different size of floral container, and showing a shift in position of the top panels and the recesses.
Figure 8:
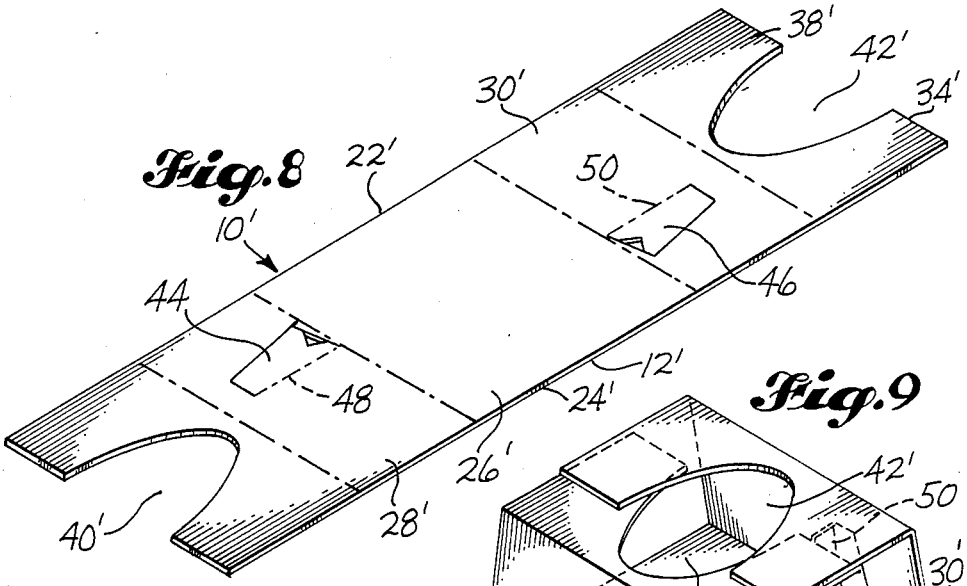
FIG. 8 is a view like FIG. 1, but of a second embodiment, adapted to serve as a stabilizing carrier for a larger floral container, such carrier being constructed to include brace flaps which extend from the end walls to the bottom of the carrier.
Figure 9:
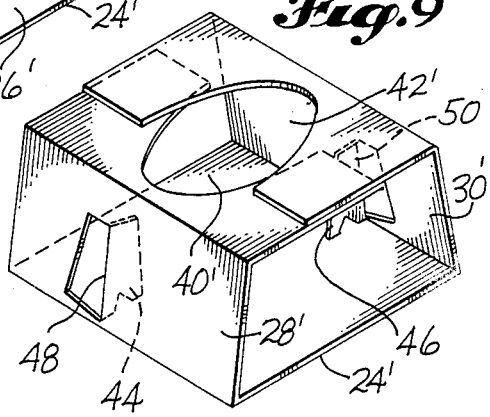
FIG. 9 is a view like FIG. 3, of the embodiment of FIG. 8.

The shape of the recesses 40, 42 results in a relatively large expansion of the container receiving opening in response to a relatively small amount of sliding movment of the end panel 34 relative to the end panel 32. As explained above, when a minimum size container V is within the opening, the curved end regions a of the recesses 40, 42 make contact with opposite side portions of the container V. As the opening becomes larger, for accommodating a larger container V', the contact of the sides of the recesses 40, 42 with the container V' occurs at four points, as shown by FIG. 7.

When the end panels 32, 34 are overlapped to the full extent possible, the opening is elongated laterally of the carrier 10. The carrier 10 is designed such that the opening is at a maximum size with respect to any container V, V' that might be used with the carrier 12 before the length of the top becomes equal to the length of the bottom panel 26. In the example above, the opening becomes large enough to receive a container V' which measures two inches in diameter where it extends through the opening at a time when the length of the top is seven inches. At the same time, the amount of overlap of the end panels 32, 34 is three and one half inches.

Referring to the embodiment shown by FIGS. 8–12, such embodiment of the carrier is designated 10'. The blank 12' of this embodiment is larger in all respects, and the recesses 40', 42' are both wider and deeper. An important difference between this embodiment and the embodiment shown by FIGS. 1–7 is the provision of a brace flap 44, 46 in each of the end panels 28', 30'. In preferred form, the brace flaps 44, 46 are struck out portions of the end walls 28', 30'. They each include a generally vertical connection or fold line 48, 50 which extends generally parallel to the side edges 22', 24' of the blank 12'. All other edges of the flaps 44, 46 are cut, so that each flap 44, 46 can be swung, like a door, about its hinge line 48, 50.

Figure 11:
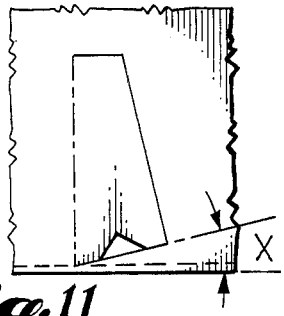
FIG. 11 is an enlarged scale fragmentary view looking towards a brace flap, prior to such brace flap being bent inwardly of the container, from the plane of its end panel.
Figure 10:
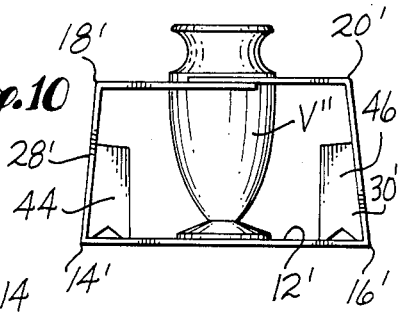
FIG. 10 is an end elevational view of the FIG. 8 embodiment, folded about a floral container, and showing the brace flaps in a bracing position.

FIG. 11 is an elevational view of the flap 44, prior to its being bent out from the end panel 28', about the fold line 48. In this view it is shown that the cut which forms the lower end of the flap 44 is made an an angle x relative to the plane of the bottom panel 26'. This angle x is chosen such that the bottom end of flap 44 makes a dragging, frictional contact with the upper surface of the bottom panel 26', when the carrier 10' is adjusted for use with its largest size floral container V''. The term "largest size" is herein used to mean a container having the largest transverse dimension or diameter within the opening formed by the two recesses 40', 42'.

Figure 12:
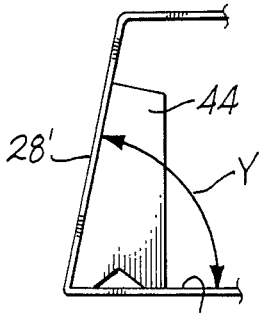
FIG. 12 is an enlarged scale fragmentary view of a base flap region of FIG. 10, showing a brace flap in side elevation.
Figure 13:
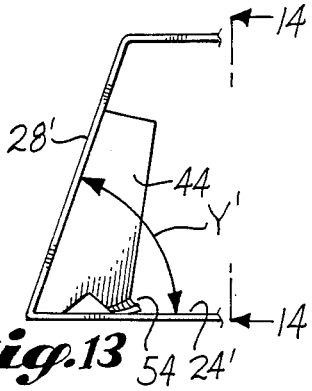
FIG. 13 is a view like FIG. 11, but showing a repositioning of the flap as a part of an adjustment of the carrier for use with a floral container which is smaller in diameter in the region of the recesses, such view showing a finger that is defined at the lower outer edge of the brace flap being bent somewhat, for adjusting it to its new position in the carrier.
Figure 14:
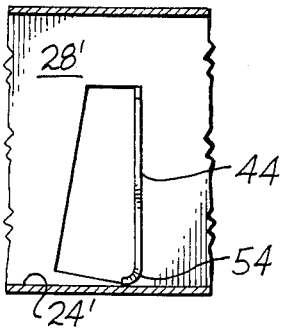
FIG. 14 is a view taken from the general aspect of line 14—14 in FIG. 13, looking towards the inwardly directed edge of a brace flap, and showing the bending of the lower finger portion of the brace flap, in the trailing direction of brace flap bending.

In preferred form, each flap 44, 46 is formed to include a recess 50 in its lower end. This recess 50 provides a finger 42 outwardly of the recess 50. Whenever the carrier 10' is used with a container V'' having a diameter within the top opening that is smaller than the maximum size diameter, the finger 52 can easily bend so as to adjust the brace flap 44, 46 for a new angle y between the end panels 28', 30' and the bottom panel 24'. In this regard, FIG. 12 shows an angle y which exists when the largest diameter of floral container V is within the top opening. At this angle y, the bottom end surfaces of the flaps 44, 46 make a dragging, frictional contact with the upper surface of the bottom panel 26', when the brace flaps 44 are swung about their hinge lines 48, 50, to extend inwardly of the carrier 10'. FIG. 13 shows a smaller angle y' which exists when a smaller diameter portion of a container V'' is within the top opening. In this case, the finger 54 bends rearwardly, easily adjusting the flap 44, 46 to the new angle, while maintaining the dragging frictional contact between the brace flaps 44, 46 and the bottom panel 26'.

By way of typical and therefore nonlimitative example, the embodiment shown by FIGS. 8–14 may measure ten inches in width, between the side edges 22', 24'. The bottom panel 26' may measure ten inches in length. The end panel 28' may measure five and one half inches in length. The end panel 30' may measure five and five eighths inches in length. The top panels 32', 34' may measure five and three quarters inches in length. In this embodiment, the region a may have a radius of curvature of about three fourths of an inch. The radius curvature of regions b, c may be about five inches. The regions d, e may measure about five eighths of an inch in length. Dimension L may measure about three fourths of an inch. W1 may be about two and a half inches. W2 may be about five inches.

Also by way of typical and therefore nonlimitative example, the flaps 44, 46 may measure about three inches at their hinges. Angle x may measure about ten degrees (10°).

In the embodiment shown by FIGS. 8–14, when the top panels 32', 34' are overlapped and adjusted into a full overlap position, the length of the top is five and three quarters inches. The contact of a container V'' with the side boundaries of the recesses 40', 42' is at four points. The opening is sized to receive a diameter of about three and one half inches. Owing to the shape of the recesses 40', 42', when the top panels 32', 34' are slid apart an amount decreasing the dimension of overlap by one inch, the opening will accommodate a four inch diameter. The length of the top is now six and three quarter inches. The maximum size diameter that can be accommodated is between four and one quarter and four and one half inches. At that time the length of the top is seven inches. The amount of overlap is about four and a quarter inches.

In both embodiments, the amount of overlap is always substantial. When the top panels 32', 34' are stapled together, they greatly stiffen the top of the carrier 10, 10'. Owing to the presence of the end walls 28, 28', 30, 30' the stapling of the top panels 32, 32', 34, 34' together can place no bending forces on the bottom panel 26, 26'.

It is to be understood that there are other modifications that can be made in constructing the carrier in accordance with the present invention. For example, the recesses in the top panels may be true or nearly true parabolas, true or nearly true hyperbolas or true or nearly true semi-ellipses. The type of recess that has been described, which is formed by a small radius region of circular curvature at the closed end of the recess, flanked by larger radius side regions, with the side regions joining tangentially to straight side regions at the outer edges of the top panels results in a recess that will cause a maximum adjustment in size of the opening within a minimum amount of adjustment of the overlap and a minimum amount of cutting away of the top panels.

What is claimed is:

1. A stabilizing carrier for a floral container, comprising:

a rectangular base panel having two ends;

two end panels having lower ends which are hinge connected to the ends of the base panel, and upper ends;

two top panels having outer ends which are hinge connected to the upper ends of the end panels, and inner free ends, with one of the top panels overlapping the other top panel, said top panels together forming a top for the carrier;

each top panel including a semi-oval recess extending inwardly from its free edge, said recesses complementing each other to form an opening in said top when said one top panel is overlapping the other top panel;

wherein in use the base of a floral container sets on said base panel and above the base said container is received within said top opening;

wherein said base panel is substantially larger than the base of the floral container; and wherein each semi-oval recess has a concave curved closed end portion and a concave curved region on each side of the closed end;

wherein the depth of each recess is substantially larger than the maximum width of the recess;

wherein said recesses progressively increase in width from said closed end outwardly to said maximum width and are of a shape to make engaging contact with opposing side regions of a plurality of different size floral containers by a mere adjustment of the amount of top panel overlap; and such adjustment of the top panel overlap changes both the length and width size of the opening.

2. A carrier according to claim 1, wherein each recess has an open end portion defined by side parts which are substantially straight and parallel to each other.

3. A carrier according to claim 1, wherein the closed end portion of each recess includes a center of curvature positioned in the recess, generally close to the closed end of the recess, and wherein each recess includes substantially identical side regions on the opposite sides of the closed end portions, each of which has a center of curvature located outwardly of the recess.

4. A carrier according to claim 3, wherein each recess has an open end portion defined by side parts which are substantially straight and parallel to each other.

5. A carrier according to claim 3, wherein the closed end of each recess is of circular curvature and the curved side regions of the recesses are also of circular curvature.

6. A carrier according to claim 4, wherein the closed end of each recess is of circular curvature and the curved side regions of the recesses are also of circular curvature.

7. A carrier according to claim 1, for use with a bud vase, or the like, which is relatively thin and tall, and wherein the carrier has a vertical height of at least two and one half inches.

8. A carrier according to claim 1, wherein the base panel, the two end panels and the two top panels are portions of a continuous piece of a relatively stiff, lightweight material, and wherein fold lines are formed in the material to hinge connect the top panels to the end panels and the end panels to the base panels.

9. A stabilizing carrier according to claim 1, each said end panel further including a brace flap, each said flap including a generally vertical hinge connection to its end panel, and a lower end positioned to make bracing contact between the end wall and the base panel when said flap is bent about said hinge connection to project inwardly of the carrier from its end wall and the top panels are together to form the carrier top.

10. A carrier according to claim 9, wherein the lower end portion of each flap is positioned to make a frictional contact with the base panel when the flap is turned to extend inwardly of the carrier from its end wall.

11. A carrier according to claim 10, wherein each said flap includes a recess in its lower edge, positioned to provide a finger laterally outwardly from said recess, such finger being positioned to contact the base panel when the flap is turned to extend inwardly from its endwall, and to bend, if necessary.

12. A carrier according to claim 9, wherein said brace flap is a struck out flap portion of the end wall and said hinge connection is provided by a fold where the flap is connected to the rest of the end wall.

* * * * *